United States Patent [19]

Gariepy, Sr.

[11] 4,018,130

[45] Apr. 19, 1977

[54] SNARE ASSEMBLY

[75] Inventor: Frank J. Gariepy, Sr., Montreal, Canada

[73] Assignees: John H. Chartbrand; Robert E. Chartbrand, Ottawa, Canada; a part interest to each

[22] Filed: Jan. 20, 1976

[21] Appl. No.: 650,681

[52] U.S. Cl. ..... 84/415

[51] Int. Cl.² ..... G10D 13/02

[58] Field of Search ..... 84/415–417

[56] References Cited

UNITED STATES PATENTS

| | | | |
|---|---|---|---|
| 1,638,106 | 8/1927 | Strupe | 84/415 |
| 1,709,165 | 4/1929 | Bower | 84/415 |
| 2,834,244 | 5/1958 | Willits | 84/415 X |
| 3,113,481 | 12/1963 | Thompson | 84/415 |

*Primary Examiner*—Lawrence R. Franklin

[57] ABSTRACT

A snare assembly for use with a snare drum has a series of generally parallel snare wires extending between terminal plates secured at opposite ends of an elongate mounting frame. The snare strands are secured in a bowed configuration, projecting upwardly from the mounting frame beyond the terminal plates, the snare wires being pretensioned. Thus when the snare assembly is pressed against the lower drum head by the conventional strainer mechanism neither the mounting frame, the terminal plates, nor those parts of the snare strands directly attached to the terminal plates, come into contact with the drum head. Thus the snare strands by virtue of their bowed configuration are at all times resiliently pressed against the drum head and provide great sensitivity and response to the vibrations of the drum head providing a high degree of definition and tonal quality even at very large volumes.

9 Claims, 6 Drawing Figures

SNARE ASSEMBLY

BACKGROUND OF THE INVENTION

1. Field of the Invention

This invention relates to improvements in snare assemblies for use in conjunction with snare drums.

2. Description of the Prior Art

At the present time, snare drums are generally equipped with helical wire snare structures anchored at opposite ends to the sides of the drum shell, one anchor point being attached to a lever operated strainer mechanism which applies tension to the snare structure and presses it into contact with the lower drum head. In such structures the pressure exerted tends to choke the snare structure resulting in a loss of volume and tonal quality. The strainer mechanism must provide both the force to tension the snare strands, and the force to press the snare structure against the drum head. With such arrangements individual strands of snare wire can become strained and physically distorted so that they sag and do not operate efficiently. As the lower drum head flexes inwards and outwards in response to pressure generated by the upper drum head being struck by a drum stick, the support of the snare strands is at times insufficient, so that undesirable vibrations (commonly referred to a "buzzing") can arise resulting in distortion of the sound. Furthermore, in such structures the snare strands are exposed on the lower drum head, and are easily damaged during transportation or relocation of the drum.

U.S. Pat. No. 3,113,481, Thompson discloses a snare unit which overcomes some of the difficulties discussed above. The Thompson snare unit provides a rectangular frame which extends diametrically across the snare head hoop and carries adjustable bridges between which the snare strands are attached and by means of which the tensioning of the snare strands can be varied as desired. However, although the snare strand tensioning is independent of the drum, the user is still required to make the necessary adjustments to achieve the correct tensioning. Over-adjustment of the tensioning means subjects snare strands to excess tension and in extreme cases can permanently damage one or more of the strands rendering the snare unit unserviceable. Underadjustment of the tensioning means creates distortion of sound commonly referred to as "buzzing" as a result of snare slack.

SUMMARY OF THE INVENTION

The present invention provides a snare assembly for use with a snare drum, comprising an elongate mounting frame; a pair of carrier means positioned at locations spaced longitudinally of said mounting frame; and a series of generally parallel snare strands extending longitudinally between and each attached at opposite end portions thereof to respective ones of said carrier means, said carrier means supporting said snare strands in an outwardly bowed configuration such that the lengths of the snare strands between said end portions project outwardly of said mounting frame and said carrier means and can be engaged resiliently against the lower drum head of the snare drum while the carrier means and mounting frame remain out of contact with the lower drum head. The snare strands are preferably mounted under a uniform pretension such that the outwardly bowed configuration is somewhat flattened over the greater part of the length of the snare wires, and preferably projects towards the drum head approximately one eighth to one quarter of an inch beyond the carrier means. With this arrangement, 85% to 95% of the length of the snare will engage the lower drum head in a resilient manner and no part of the mounting frame or carrier means touches the drum head. Consequently the snares are free to respond fully to vibrations of the drum head and the risk of the latter being damaged by rigid parts of the snare assembly is effectively reduced.

The snare assembly may incorporate commercially available snare units, in which the required number of strands, for example, ten, twelve, fourteen or twenty stainless steel coiled wires, extend between and are soldered at their ends to generally flat terminal plates, the terminal plates being connected to respective ones of the carrier means at an orientation such that the end portions of the snare wires extend at an angle of between 5° and 30°, and preferably about 10° to 15°, to the length of the mounting frame.

In preferred embodiments of my snare assembly, the preset tensioning of the snare wires automatically accommodates the snare head to operate efficiently under all playing conditions, and consequently no adjustment of snare tension is required throughout the life of the snare assembly. The snare assembly being provided as a unit, it may be quickly mounted on or removed from a snare drum utilizing the conventional mounting and strainer attachments, and it can be utilized with most snare drums of appropriate diameter without requiring special adaptors or modifications to the drum itself. The bowed configuration of the snare wires allow them to maintain contact pressure against the drum head, without subsequently distorting or sagging, and thus eliminates buzzing effects or other sound distortions, and ensures that no fixed part of the assembly, such as terminal plates or mounting frame contacts the drum head.

DESCRIPTION OF THE DRAWINGS

The invention will further be described by way of example only, with reference to the accompanying drawings wherein.

DESCRIPTION OF THE PREFERRED EMBODIMENT

Figure 1:
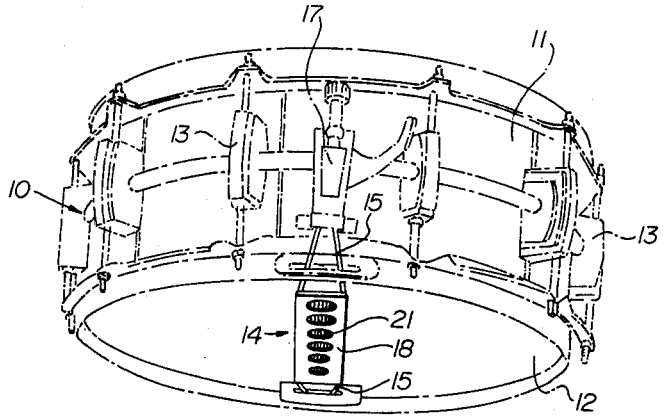
FIG. 1 is a perspective view of a snare drum fitted with a snare assembly in accordance with the invention.

FIG. 1 illustrates a snare drum 10 of known construction comprising a cylindrical shell 11, a lower drum head 12, an upper drum head (not shown), and a series of fittings 13 around the drum shell for adjusting the tension of the drum heads.

A snare assembly generally indicated at 14 is suspended adjacent the lower drum head 12 by means of cords 15 between mountings on opposite sides of the drum shell 11. The cords are passed through holes 28 passing through opposite ends of the snare assembly.

Figure 5:
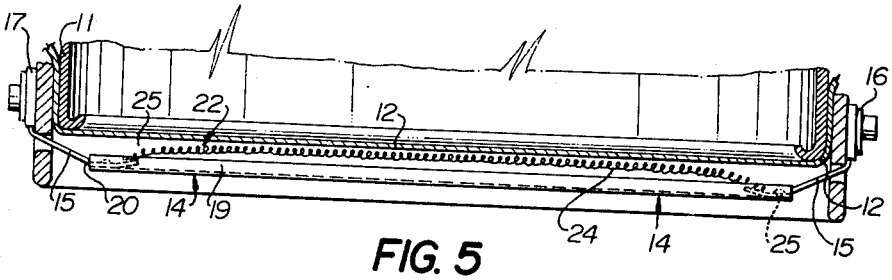
FIG. 5 is a somewhat schematic sectional view through the lower end of a snare drum illustrating the snare assembly in the retracted position.

Alternatively, the assembly may be suspended by means of straps (not shown) passing through slots 29 at the opposite ends thereof. As shown in FIG. 5 the mountings may be of conventional form, namely on one side a screw operated clamp 16, and on the other side a lever operated strainer mechanism 17.

Figure 2:
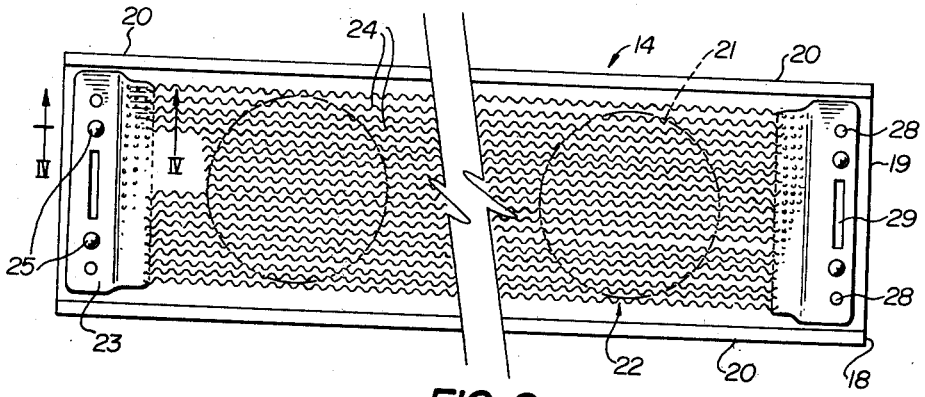
FIG. 2 is a fore-shorted plan view of the snare assembly.
Figure 3:
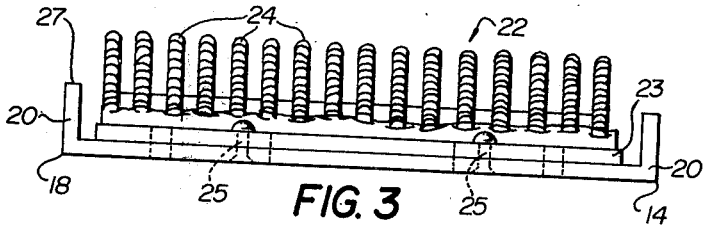
FIG. 3 is an end view of the snare assembly.
Figure 4:
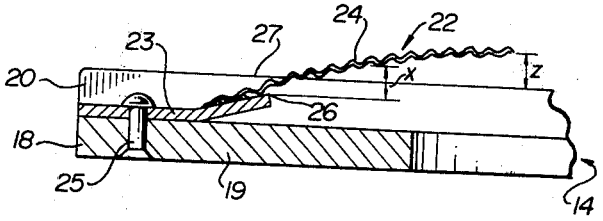
FIG. 4 is a fragmentary sectional view to an enlarged scale, taken generally on the line IV—IV in FIG. 2.

As shown more clearly in FIGS. 2, 3 and 4, the snare assembly comprises an elongated channel shaped mounting frame 18 of aluminum or aluminum alloy, having a flat base 19, and longitudinal walls 20 on opposite sides, the base being provided with a series of large holes 21.

A snare unit 22 comprising a series of closely spaced parallel helically coiled snare strands 24 of stainless steel wire extends longitudinally of the mounting frame, the ends of the snare unit comprising generally flat terminal plates 23 to which the end portions of each snare strand are attached as by soldering.

Each terminal plate 23 is secured to the corresponding end of the mounting frame 18 through a carrier means in the form of a pair of rivets 25 received through aligned holes in each terminal plate 23 and in opposite ends of the base 19 of the mounting frame, whereby the terminal plates 23 and thus the snare unit are secured to the mounting frame. The snare unit 22 is attached to the mounting frame under a preset tension which is selected to provide the desired tonal quality in use. This tension varies according to the type and number of snare strands in the unit. In the embodiment illustrated, having 20 helical stainless steel snare strands, a tension of about 15 lbs. has been found to be suitable. If desired, means may be provided for adjustment of the position of one or other of the terminal plates longitudinally of the mounting frame at the time of assembly to achieve the desired tension. For example the holes in either a terminal plate or the mounting frame base may be elongated. However, commercially available snare units have been found which are sufficiently consistent as to qualify that provision for such adjustment was in some cases unnecessary.

The carrier means are arranged to impart a longitudinally bowed configuration to the snare strands, as can best be seen in FIGS. 4 and 5. To this end, the portion of each terminal plate 23 to which the snare strands are attached is arranged at an inclination with respect to the longitudinal direction of the mounting frame thus imparting a corresponding inclination to the end portions of the individual snare wires 24 as seen in FIG. 4. This inclination, which in the embodiment illustrated is approximately 11°, has the effect of displacing the major portion of the length of each snare wire 24 outwardly from the mounting frame 18 beyond the terminal plates 23, the extent of this projection, as indicated by the dimension $x$ in FIG. 4, being approximately ¼ of an inch. It will be seen from FIG. 4 that the upper edge 26 of the inclined portion of the terminal plate lies below the upper edges 27 of the walls 20 of the mounting frame by approximately ⅛ inch, so that the snare strands 24 extend above the walls 20 by a dimension $z$ in FIG. 4, in the embodiment described approximately ⅛ inch. The preset tension applied to the snare unit 22 during construction of the snare assembly has the effect of flattening the bowed configuration of the snare strands over approximately 90% their lengths, as can be seen from FIG. 5, the maximum curvature of the snare strands thus being located near the end portions thereof.

Figure 6:
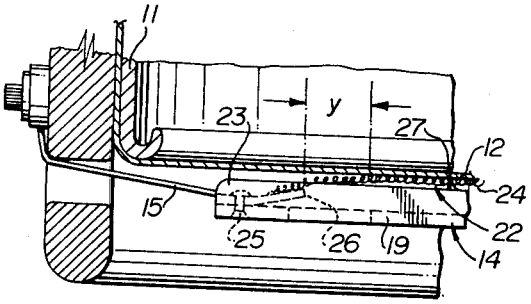
FIG. 6 is an enlarged fragmentary view corresponding to FIG. 5, illustrating the snare assembly in the applied condition.

With the above described arrangement, when the strainer mechanism 17 is operated to move the snare assembly from the retracted position shown in FIG. 5 to the operative position shown in FIG. 6, movement of the cord 15 attached to the strainer unit draws the snare assembly up against the lower drum head 12.

In the operative or fully engaged position of the snare assembly, the snare strands 24 contact the drum head 12 throughout the major portion (i.e. approximately 85% to 95%, or 88% as shown) of their lengths. However, there remains a short length indicated by the dimension $y$ in FIG. 6, at each end of the snare strands but beyond the inboard edge of the terminal plate 23, which does not contact the drum head 12. In other words, when the snare assembly is fully engaged, there still remains clearance between the terminal plates 23 and the drum head 12, the end portions of the snare wires 24 where they are attached to the terminal plates 23 being spaced from the drum head 12. Thus, engagement between the snare assembly 14 and the drum head 12 is solely through the resilient contact of the bowed lengths of the snare strands 24 between their end portions, so that no rigid part of the snare assembly contacts the drum head. This arrangement enables individual ones of the snare strands 24 to accommodate themselves under their individual resilient forces to the surface of the drum head 12, so that each snare wire is free to respond to the vibrations of the drum head, and no strand tends to sag decreasing efficiency and producing distortions in sound such as buzzing.

It will be seen that the above described snare assembly is readily adaptable for use with virtually any snare drum of the correct diameter, since it utilizes conventional attachment means such as the screw clamp 16 and strainer mechanism 17. Since the tension of the snare strands is preset at manufacture, each snare strand applies equal and consistent pressure to the drum head during use, so that the snare assembly can maintain control and physical composure under playing conditions and respond fully to vibrations of the drum head without generating any distortions in sound. Presetting of the snare strands eliminates the likelihood of these becoming strained in use due to maladjustment, and therefore provides increased life and improved performance to the assembly. The configuration of the aluminum mounting plate affords a degree of protection to the snare strands against accidental damage during transportation, since once the strands are depressed through the distance $z$ as shown in FIG. 4 they are shielded by the walls 20 of the mounting frame. The strands are also protected from damage in use due to over-adjustment of the strainer mechanism 17 since in that event the upper edges 27 of the walls 20 contact the lower drum head 12 thus relieving the snare strands of additional loading.

Various modifications to the structure described above are possible without departing from the scope of the invention as set out in the attached claims. Thus the terminal plates to which the snare strands are attached could be made integral with the mounting frame or attached thereto other than by riveting e.g. by screw and nut fasteners, glueing, soldering, welding or cementing. Furthermore, although in my view such would not in most cases be advantageous, means could be provided for adjusting one or other of the terminal plates longitudinally of the mounting plate to effect in use variation of the tension of the snare strands.

Furthermore, the angular disposition of the end portions of the snare strands, and the projection of the snare strands above the mounting frame can be varied substantially while still retaining at least some of the advantages of the preset invention. Thus, whereas in the embodiment disclosed above the angle of the end portions of the snare strands to the length of the mounting plate is 11°, this could be varied between 10° and 20°, and possibly even from 5° to 30° or higher. Similarly, the projection of the snare strands above the mounting frame could be varied between 1/16 inch and ⅜ inch or even more.

What I claim as my invention is:

1. A snare assembly for use with a snare drum, comprising an elongate mounting frame; a pair of carrier means positioned at locations spaced longitudinally of said mounting frame; and a series of generally parallel snare strands extending longitudinally between and each attached at opposite end portions thereof to respective ones of said carrier means, said carrier means supporting said snare strands in an outwardly bowed configuration such that the lengths of the snare strands between said end portions project outwardly of said mounting frame and said carrier means and can be engaged resiliently against the lower drum head of the snare drum while the carrier means and mounting frame remain out of contact with the lower drum head.

2. A snare assembly according to claim 1 wherein said snare strands are under uniform tension such that the outwardly bowed configuration is somewhat flattened over the major portion of the length of each snare strand.

3. A snare assembly according to claim 2 wherein the outwards projection of said snare strands is between about one sixteenth and three eighths of an inch.

4. A snare assembly according to claim 3 wherein said projection is approximately one quarter of an inch.

5. A snare assembly according to claim 3 wherein said mounting frame includes longitudinally extending lateral surfaces on opposite sides of said snare strands projecting outwardly in the same direction as said projection of said snare strands, said terminal plates being recessed slightly between said surfaces.

6. A snare assembly according to claim 5 wherein said terminal plates are recessed below said lateral surfaces by approximately one eighth of an inch and said outwards projection of said snare strands beyond said lateral surfaces is approximately one eighth of an inch.

7. A snare assembly according to claim 2 wherein the end portions of each snare strand are attached to respective ones of a pair of terminal plates each terminal plate being connected to said mounting frame such that the end portions of the snare wires extend at an angle of at least 5° to the length of the mounting frame.

8. A snare assembly according to claim 7 wherein said angle lies between about 5° and about 30°.

9. A snare assembly according to claim 7 wherein said angle lies between about 10° and about 20°.

* * * * *

UNITED STATES PATENT AND TRADEMARK OFFICE

CERTIFICATE OF CORRECTION

PATENT NO. : 4,018,130

DATED : April 19, 1977

INVENTOR(S) : Frank J. Gariepy, Sr.

It is certified that error appears in the above-identified patent and that said Letters Patent are hereby corrected as shown below:

In heading: [73] Assignees: John H. Chartbrand and Robert E. Chartbrand should read:

--John H. Chartrand and Robert E. Chartrand--

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*